US009511404B1

(12) United States Patent
Huang

(10) Patent No.: US 9,511,404 B1
(45) Date of Patent: Dec. 6, 2016

(54) SHEET MOLDING DEVICE

(71) Applicant: Po Ming Huang, Taichung (TW)

(72) Inventor: Po Ming Huang, Taichung (TW)

( * ) Notice: Subject to any disclaimer, the term of this patent is extended or adjusted under 35 U.S.C. 154(b) by 0 days.

(21) Appl. No.: 14/788,820

(22) Filed: Jul. 1, 2015

(51) Int. Cl.

| | |
|---|---|
| ***B21D 26/021*** | (2011.01) |
| ***B21D 26/029*** | (2011.01) |
| ***B21D 37/16*** | (2006.01) |
| ***B21D 22/02*** | (2006.01) |
| ***B21D 26/02*** | (2011.01) |
| ***B21D 26/055*** | (2011.01) |
| ***B21D 45/02*** | (2006.01) |

(52) U.S. Cl.
CPC ..... *B21D 26/029* (2013.01); *B21D 22/022* (2013.01); *B21D 26/02* (2013.01); *B21D 26/021* (2013.01); *B21D 26/055* (2013.01); *B21D 37/16* (2013.01); *B21D 45/02* (2013.01)

(58) Field of Classification Search
CPC ..... B21D 26/021; B21D 22/022; B21D 26/02; B21D 26/055; B21D 45/02; B21D 26/029; B21D 37/16
USPC ..... 72/60
See application file for complete search history.

(56) References Cited

U.S. PATENT DOCUMENTS

| | | | | |
|---|---|---|---|---|
| 6,615,631 | B2 * | 9/2003 | Kleber | B21D 45/02 72/427 |
| 6,694,790 | B2 * | 2/2004 | Ryntz | B21D 26/055 72/60 |
| 6,907,761 | B2 * | 6/2005 | Spence | B21D 26/055 29/421.1 |
| 6,997,025 | B2 * | 2/2006 | Friedman | B21D 26/055 29/421.1 |
| 7,021,099 | B2 * | 4/2006 | Bennett | B21D 45/02 72/344 |
| 7,905,128 | B2 * | 3/2011 | Matsen | B21D 26/02 219/634 |
| 8,375,758 | B1 * | 2/2013 | Matsen | B21D 22/022 72/342.7 |
| 2013/0160511 | A1 * | 6/2013 | Huang | B21D 26/021 72/60 |

* cited by examiner

*Primary Examiner* — David B Jones

(57) ABSTRACT

A sheet molding device contains: a base, a mold, and at least one spray nozzle. The base includes a forming zone and a removing zone. The mold includes a molding part, an insolation washer, and a sealing part. The molding part has a peripheral rib, a die cavity, and a first heater. The insolation washer has a melting point higher a sheet, and the insolation washer is connected with a top surface of the peripheral rib and its top surface is higher than the peripheral rib. The sealing part has an outlet connecting with a high-pressure gas supply unit via an air pipe and has a second heater. The molding part and the sealing part are connected together in the forming zone, and after blow molding the sheet, the sealing part is moved toward the removing zone. Furthermore, the at least one spray nozzle is arranged in the removing zone.

8 Claims, 7 Drawing Sheets

SHEET MOLDING DEVICE

FIELD OF THE INVENTION

The present invention relates to a sheet molding device which cools and removes a sheet quickly.

BACKGROUND OF THE INVENTION

A conventional sheet molding device is disclosed in TW M447804 to mold a metal sheet, and after molding the metal sheet, a molding part and the metal sheet are moved into a cooling groove, such that temperatures of the molding part and the metal sheet are reduced to cool and remove the metal sheet. However, such a cooling and removing process takes a long time.

In addition, the metal sheet is placed on a top surface of the molding part, and the molding part and a sealing part clamp the metal sheet so that the metal sheet is heated and blow molded. Unfortunately, the metal sheet is melted easily, because a high temperature occurs and the molding part and the sealing part clamp the metal sheet forcefully, so the melted metal sheet penetrates into orifices on the top surface of the molding part, and the metal sheet adheres with the molding part securely and cannot be removed.

The present invention has arisen to mitigate and/or obviate the afore-described disadvantages.

SUMMARY OF THE INVENTION

The primary object of the present invention is to provide a sheet molding device which cools and removes a sheet quickly.

To obtain the above objects, a sheet molding device provided by the present invention contains: a base, a mold, and at least one spray nozzle.

The base includes a forming zone and a removing zone.

The mold includes a molding part, an insolation washer, and a sealing part. The molding part has a peripheral rib arranged on a top surface thereof, a die cavity defined inside the peripheral rib, and a first heater disposed on a bottom surface thereof to heat the molding part. The insolation washer is formed in a ring shape and its melting point is higher a sheet, wherein the insolation washer is connected with a top surface of the peripheral rib and its top surface is higher than that of the peripheral rib to accommodate the sheet, the sealing part has an outlet defined therein and connecting with a high-pressure gas supply unit via an air pipe, wherein the sealing part has a second heater mounted on a top surface thereof to heat the sealing part, the molding part and the sealing part are connected together in the forming zone, and after blow molding the sheet, the sealing part is moved toward the removing zone.

The at least one spray nozzle is arranged in the removing zone to spray cooling substances toward the sheet on the molding part.

DETAILED DESCRIPTION OF THE PREFERRED EMBODIMENTS

Figure 1:
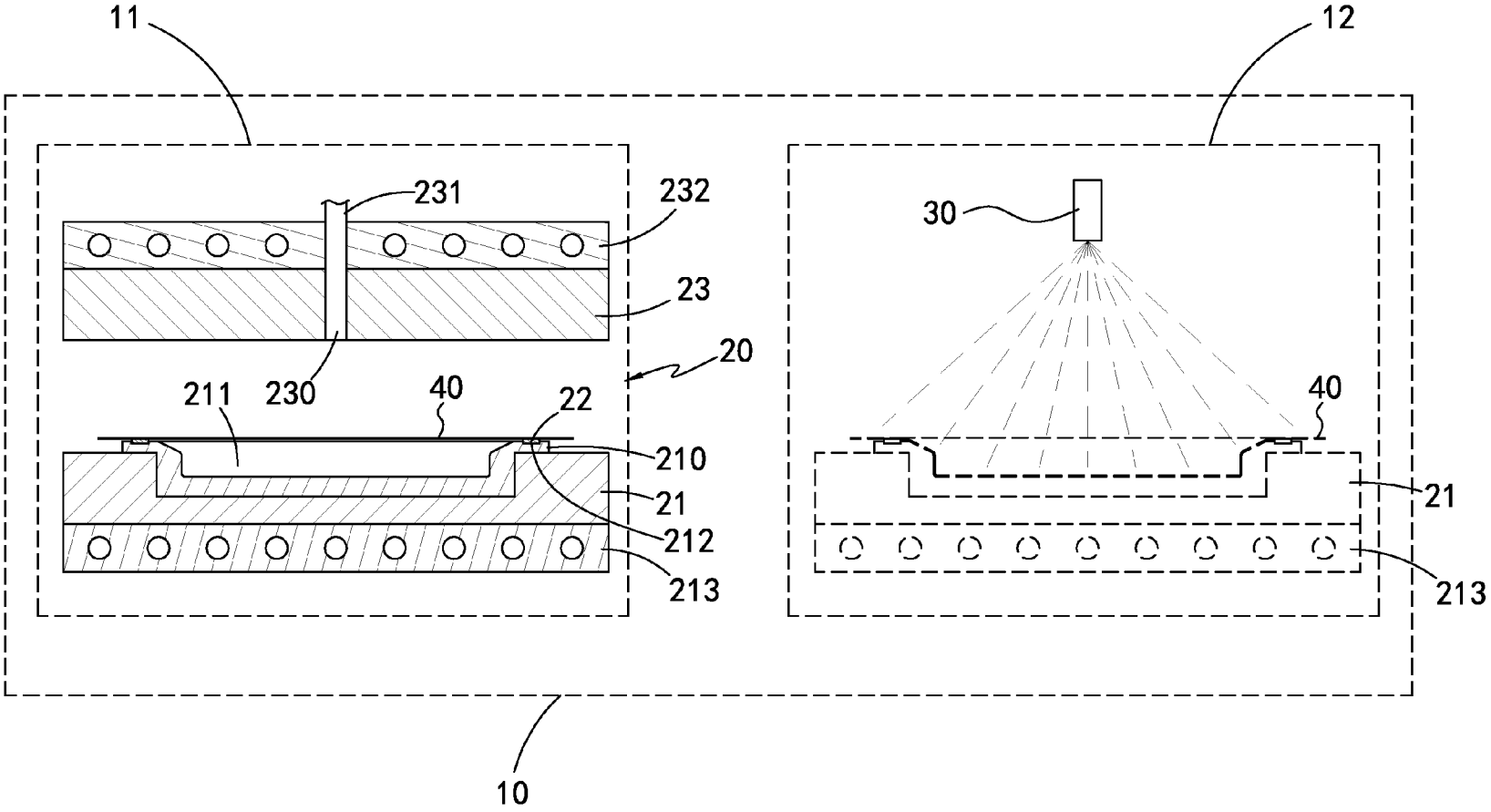
FIG. 1 is a cross sectional view showing the assembly of a sheet molding device according to a preferred embodiment of the present invention.

With reference to FIGS. 1 to 4, a sheet molding device according to a preferred embodiment of the present invention comprises: a base 10, a mold 20, and at least one spray nozzle 30.

The base 10 includes a forming zone 11 and a removing zone 12.

The mold 20 includes a molding part 21, an insolation washer 22, and a sealing part 23. The molding part 21 has a peripheral rib 210 arranged on a top surface thereof, a die cavity 211 defined inside the peripheral rib 210, and a surrounding groove 212 formed on a top of the peripheral rib 210. The molding part 21 also has a first heater 213 disposed on a bottom surface thereof to heat the molding part 21. The insolation washer 22 is formed in a ring shape and its melting point is higher than the sheet 40. For example, when the sheet 40 is made of aluminum, the insolation washer 22 is made of stainless steel or copper; and when the sheet 40 is made of rubber or plastic, the insolation washer 22 is made of aluminum. A lower portion of the insolation washer 22 is retained with the surrounding groove 212 of the peripheral rib 210, and when the insolation washer 22 is retained with the surrounding groove 212, a top surface of the insolation washer 22 is higher than that of the peripheral rib 210 to accommodate the sheet 40. The sealing part 23 has an outlet 230 defined therein and connecting with a high-pressure gas supply unit (not shown) via an air pipe 231. The high-pressure gas supply unit supplies high-pressure gas and sprays the high-pressure gas out of the outlet 230 through the air pipe 231. The sealing part 23 has a second heater 232 mounted on a top surface thereof to heat the sealing part 23. The molding part 21 and the sealing part 23 are connected together in the forming zone 11, such that a bottom surface of the sealing part 23 presses the sheet 40 on the top surface of the insolation washer 22 to blow mold the sheet 40. After blow molding the sheet 40, the sealing part 23 is moved toward the removing zone 12. In this embodiment, each of the first heater 213 and the second heater 232 is an electric heating tube or a high frequency heater.

The at least one spray nozzle 30 is arranged in the removing zone 12 to spray cooling substances, such as, gas, coolant or cooling mist toward the sheet 40 on the molding part 21, thus cooling and releasing the sheet 40 quickly. In this embodiment, a number of the at least one spray nozzle 30 is any one of two, three, and four.

Figure 2:
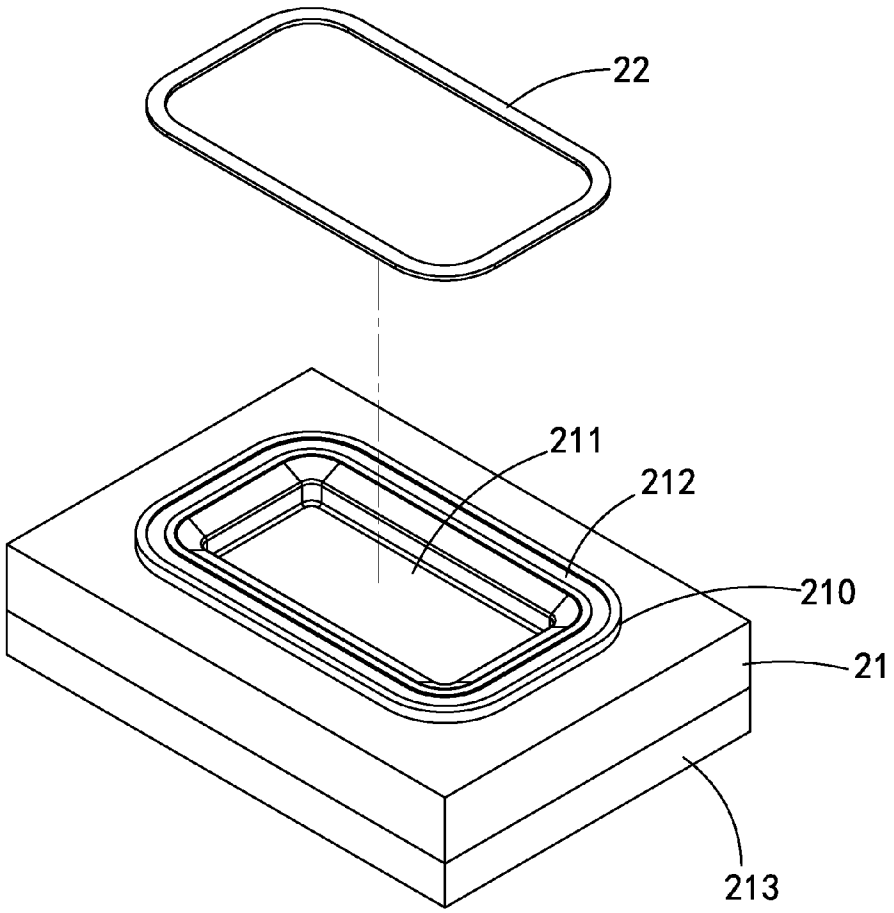
FIG. 2 is a perspective view showing the exploded components of a part of the sheet molding device according to the preferred embodiment of the present invention.
Figure 3:
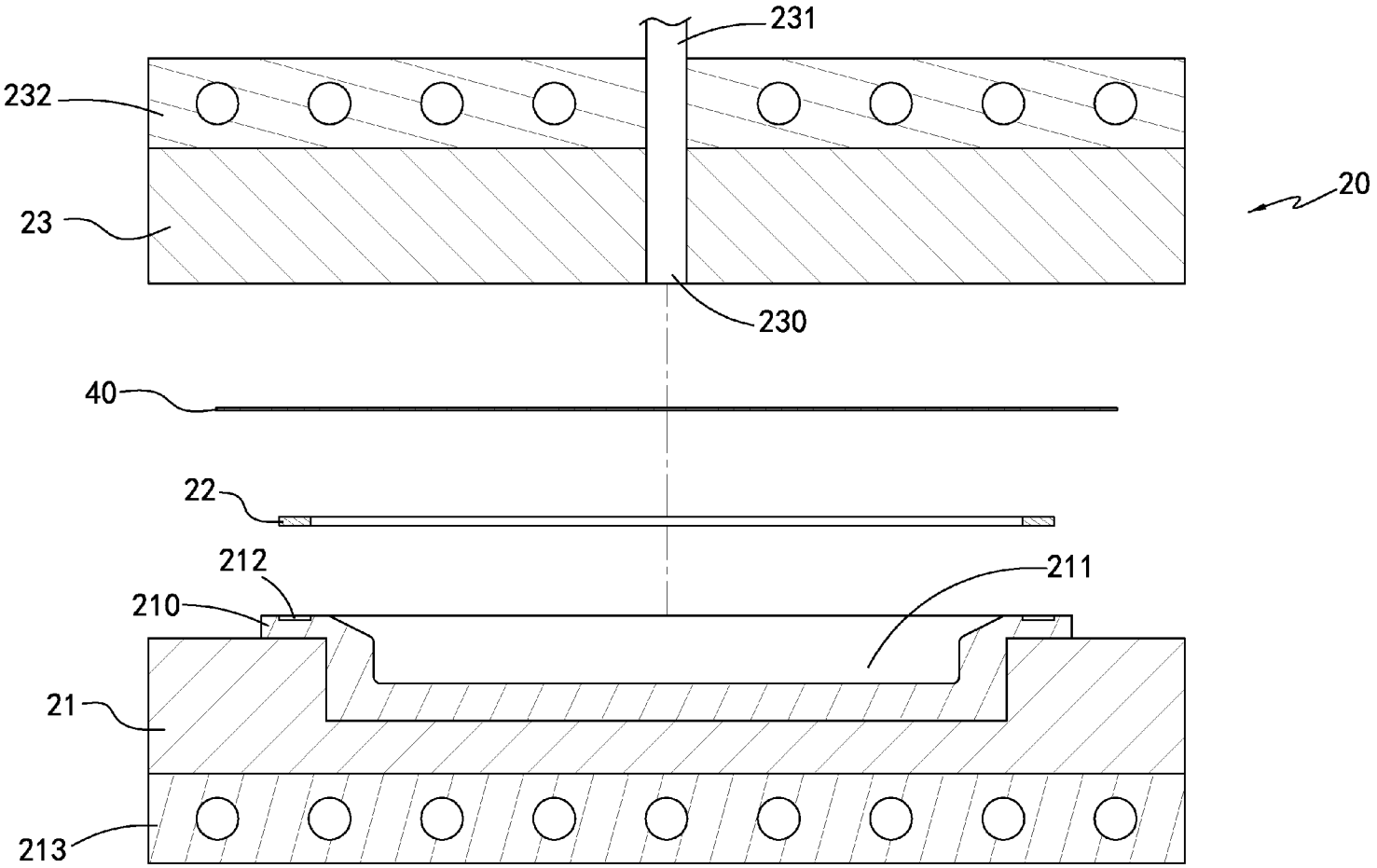
FIG. 3 is a cross sectional view showing the exploded components of a part of the sheet molding device according to the preferred embodiment of the present invention.
Figure 4:
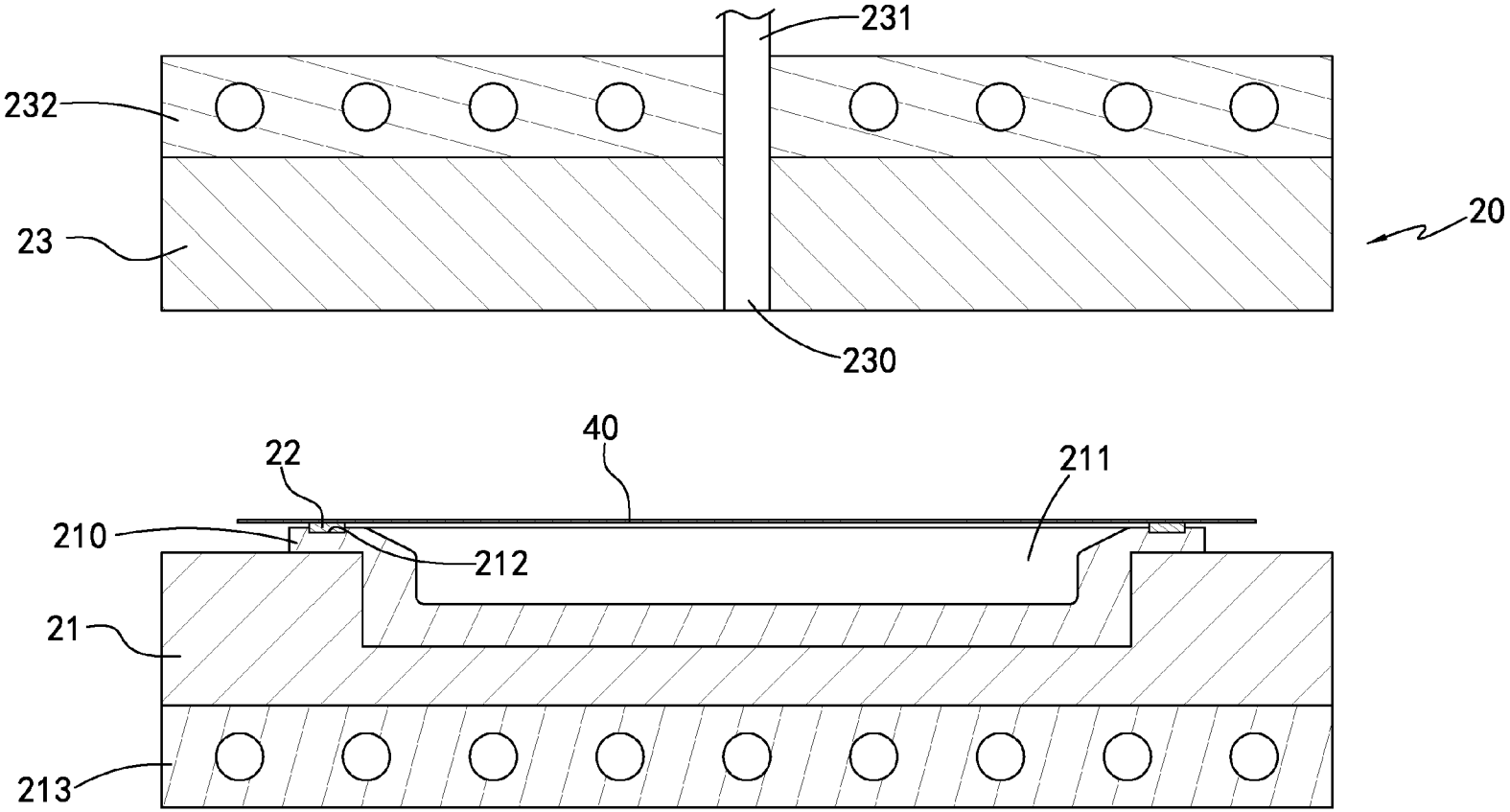
FIG. 4 is a cross sectional view showing the operation of the sheet molding device according to the preferred embodiment of the present invention.
Figure 5:
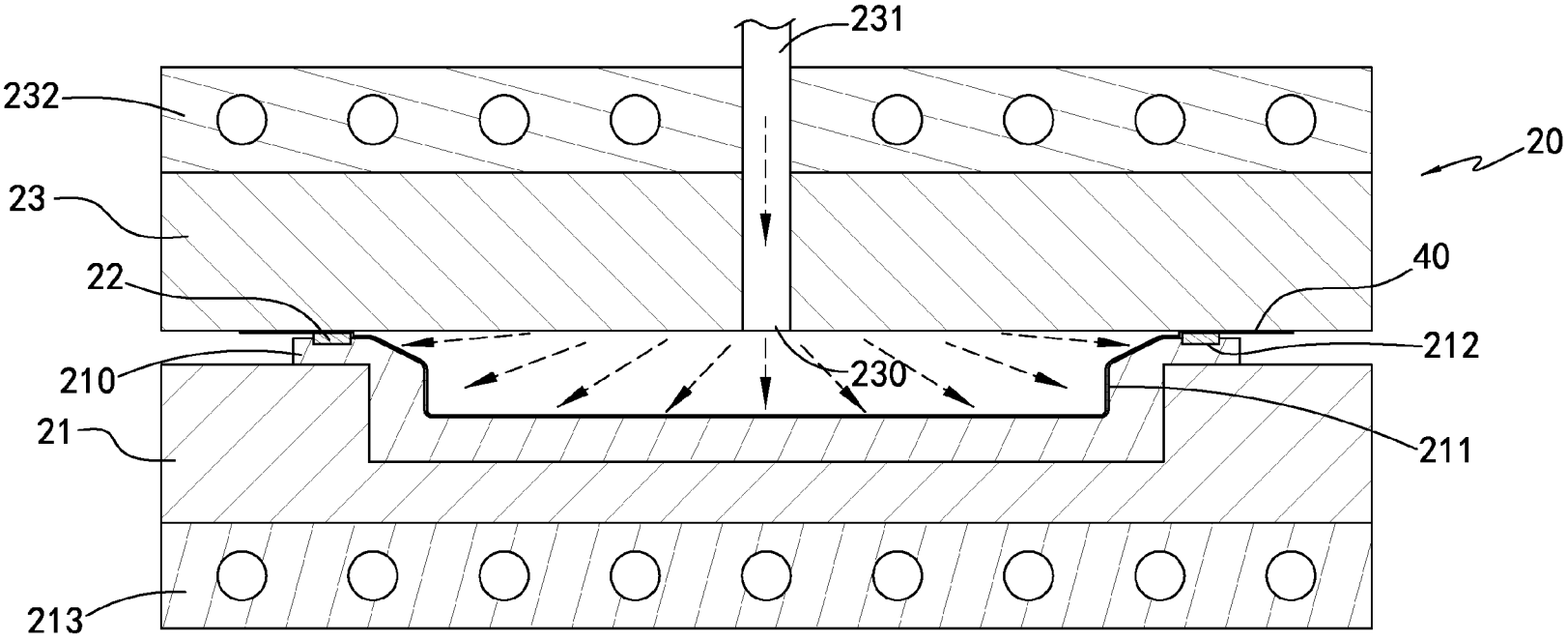
FIG. 5 is another cross sectional view showing the operation of the sheet molding device according to the preferred embodiment of the present invention.
Figure 6:
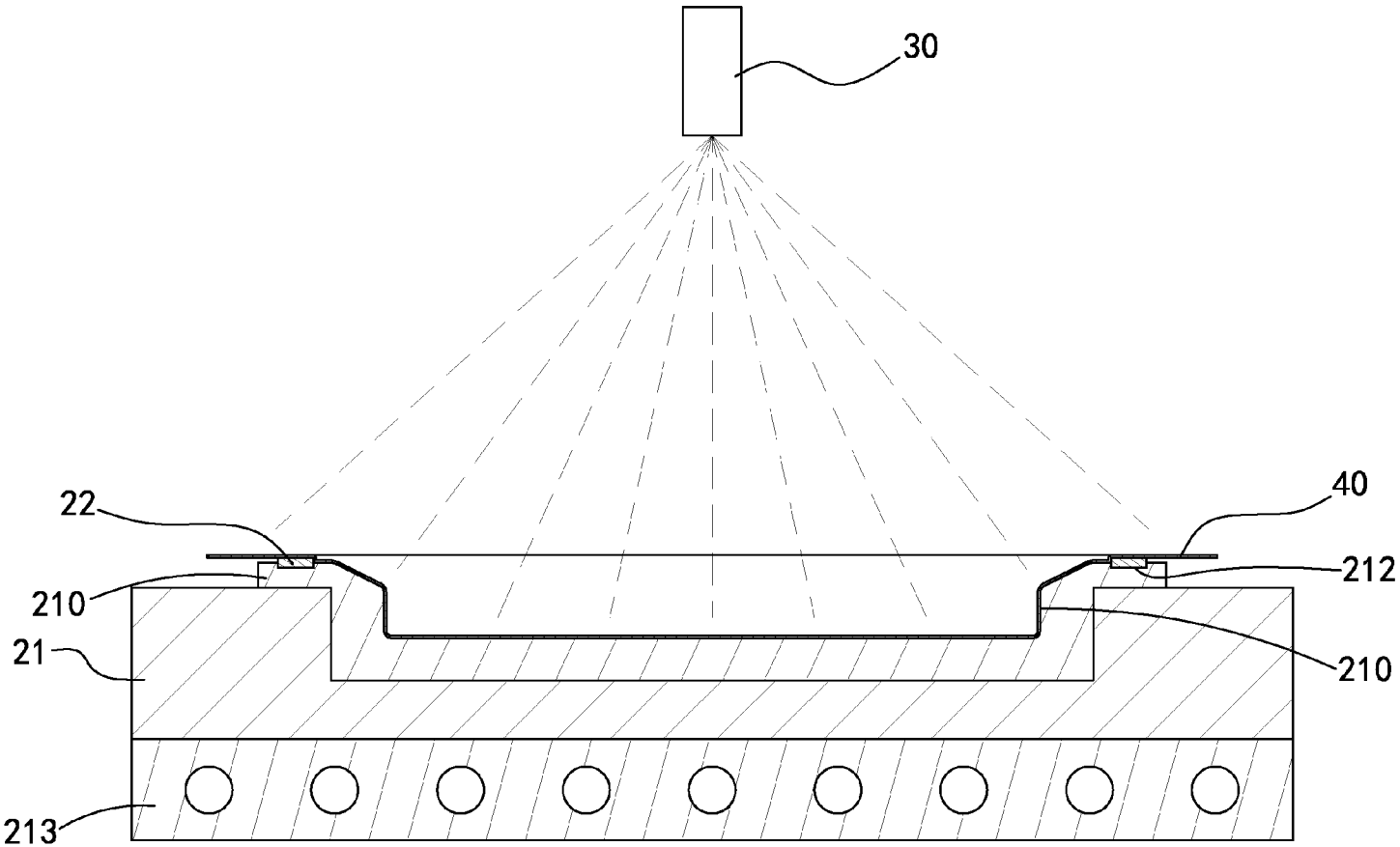
FIG. 6 is also another cross sectional view showing the operation of the sheet molding device according to the preferred embodiment of the present invention.
Figure 7:
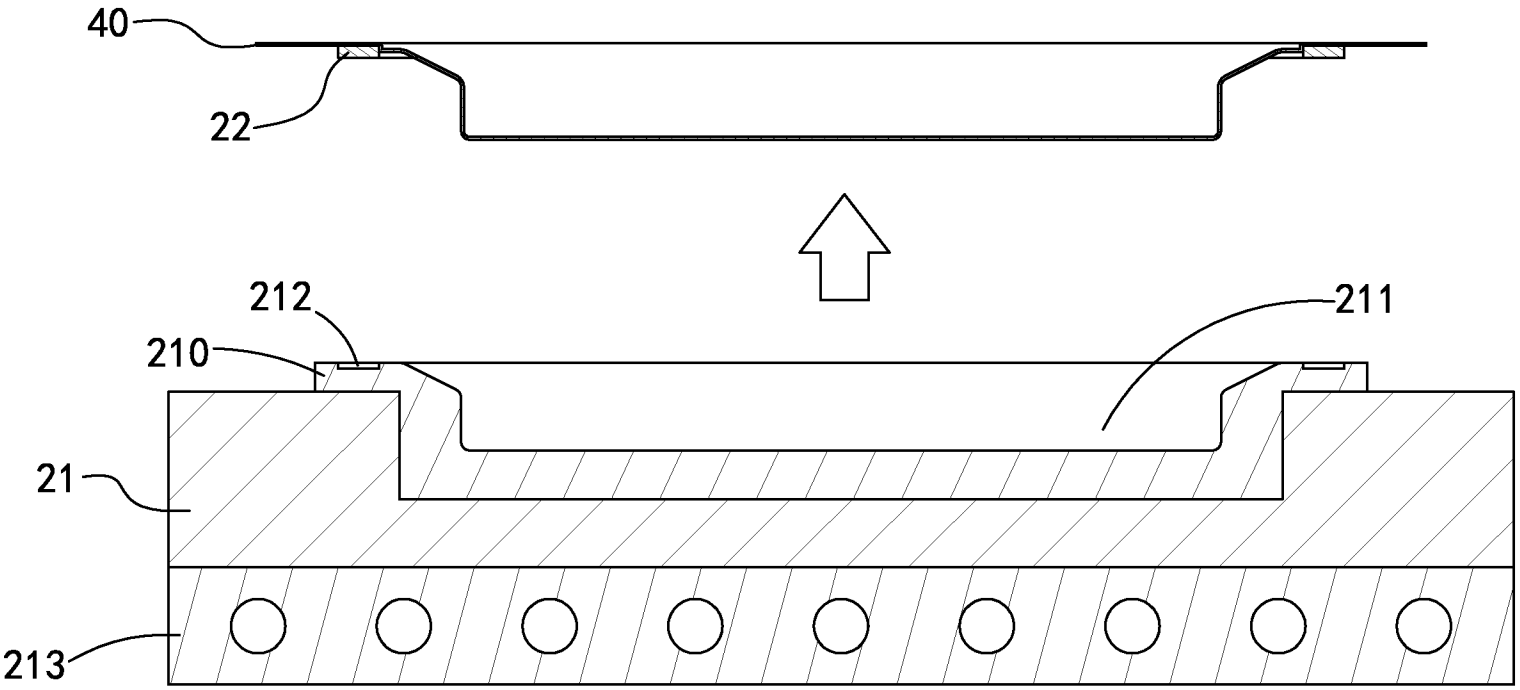
FIG. 7 is still another cross sectional view showing the operation of the sheet molding device according to the preferred embodiment of the present invention.

Referring to FIGS. 4 to 7, in operation, the insolation washer 22 is retained with the surrounding groove 212 (as shown in FIGS. 2 and 3), and the sheet 40 is placed on the top surface of the insolation washer 22 to cover the die cavity 211 (as illustrated in FIG. 4), then the molding part 21 is connected with the sealing part 23 in the forming zone 11 and is pressed to contact with the sheet 40 (as shown in FIG. 1), thereafter the first heater 213 and the second heater 232 heat the molding part 21 and the sealing part 23 to shape the sheet 40 easily. The high-pressure gas supply unit inputs the high-pressure gas from the outlet 230 to the sheet 40 via the air pipe 231, such that the sheet 40 contacts with the die cavity 211 (as shown in FIG. 5) matingly. Thereafter, a pressure in the high-pressure gas supply unit is released, and the molding part 21 is removed from the sealing part 23, then the molding part 21 and the sheet 40 are moved into the removing zone 12 so that the at least one spray nozzle 30 sprays the gas, the liquid or the cooling fluid toward the sheet 40 on the molding part 21, thus cooling and releasing the sheet 40 quickly (as illustrated in FIG. 6). Thereafter, the sheet 40 and the insolation washer 22 are removed from the molding part 21 (as shown in FIG. 7), and the sheet 40 is trimmed to obtain a finished sheet product.

Because the at least one spray nozzle 30 sprays the gas, the liquid or the cooling fluid toward the sheet 40 on the molding part 21, the sheet 40 is cooled and released quickly, and a temperature of the molding part 21 is not lowered greatly so that the molding part 21 is heated quickly, hence the sheet 40 does not adhere on the molding part 21 by ways of the insolation washer 22. Since the melting point of the insolation washer 22 is higher than that of the sheet 40, the isolation washer 22 does not adhere on the molding part 22, thus removing the sheet 40 and the isolation washer 22 from the molding part 21 easily. Preferably, after the sheet 40 is molded, it adheres with the isolation washer 22 to reinforce its structure and to avoid deformation.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A sheet molding device comprising:

a base including a forming zone and a removing zone;

a mold including a molding part, an insolation washer, and a sealing part, wherein the molding part has a peripheral rib arranged on a top surface thereof, a die cavity defined inside the peripheral rib, and a first heater disposed on a bottom surface thereof to heat the molding part, the insolation washer is formed in a ring shape and a melting point of the insolation washer is higher than that of a sheet to be formed in the sheet molding device, wherein the insolation washer is connected with the peripheral rib and extends above the peripheral rib so as to accommodate the sheet, the sealing part has an outlet connecting with a high-pressure gas supply unit via an air pipe, wherein the sealing part has a second heater configured to heat the sealing part, the molding part and the sealing part are connected together in the forming zone, and after blow molding the sheet, the sealing part is moved toward the removing zone; and at least one spray nozzle arranged in the removing zone to spray cooling substances toward the sheet on the molding part.

2. The sheet molding device as claimed in claim 1, wherein the molding part has a surrounding groove formed on a top surface of the peripheral rib, and the insolation washer is retained with the surrounding groove of the peripheral rib.

3. The sheet molding device as claimed in claim 2, wherein the insolation washer is made of aluminum.

4. The sheet molding device as claimed in claim 2, wherein the insolation washer is made of stainless steel.

5. The sheet molding device as claimed in claim 2, wherein the insolation washer is made of copper.

6. The sheet molding device as claimed in claim 2, wherein the cooling substances sprayed from the at least one spray nozzle is gas.

7. The sheet molding device as claimed in claim 2, wherein the cooling substances sprayed from the at least one spray nozzle is coolant.

8. The sheet molding device as claimed in claim 2, wherein the cooling substances sprayed from the at least one spray nozzle is cooling mist.

* * * * *